United States Patent [19]

Berglund et al.

[11] 4,095,634

[45] Jun. 20, 1978

[54] PLANT FOR FINGER-JOINTING WOOD-BOARDS

[75] Inventors: Benkt Berglund, Sollentuna; Olov Ohlsson, Österskär, both of Sweden

[73] Assignee: Svenska A.B. Elphiac, Solna, Sweden

[21] Appl. No.: 782,835

[22] Filed: Mar. 30, 1977

[51] Int. Cl.[2] ..... B27F 5/00

[52] U.S. Cl. ..... 144/317; 144/327; 144/3 R; 156/322; 156/380; 156/535

[58] Field of Search ..... 156/304, 322, 258, 535, 156/380; 144/327, 317, 3 R

[56] References Cited

U.S. PATENT DOCUMENTS

| | | | |
|---|---|---|---|
| 3,126,308 | 3/1964 | Brockerman et al. | 156/380 |
| 3,802,982 | 4/1974 | Forsythe | 156/322 |
| 3,985,169 | 10/1976 | Chow | 144/317 |

*Primary Examiner*—Donald R. Schran
*Attorney, Agent, or Firm*—Bacon & Thomas

[57] ABSTRACT

In the new plant for finger-jointing wood-boards described herein, dielectric heating is applied to the crude ends of the boards before the fingers are cut in them. The ends of the boards only are fed in and out of the dielectric heating means and conveyed to finger cutting means where fingers are cut in the heated ends. Glue is applied to the hot cut fingers and assembling and pressing together of the hot glue-coated fingers is performed rapidly. The curing of the glue is provided by the heat accumulated in the ends of the boards.

13 Claims, 2 Drawing Figures

PLANT FOR FINGER-JOINTING WOOD-BOARDS

BACKGROUND OF THE INVENTION

The invention pertains to a plant for finger-jointing wood boards in an end-to-end relationship. Plants for finger-jointing wood-boards are already known and comprise means for transporting the wood-boards through the plant, a finger-cutting device cutting wedge-like fingers into the ends of the boards, a glueing device for applying glue on the cutted fingers and an assembling and pressing device wherein the boards are assembled in an end-to-end relationship with the glue-coated fingers engaged in one another and afterwards firmly pressed together. After leaving the press, the assembled long board is cut to desired lengths and the glue in the joints between the fingers has to be cured, for instance during storage of the jointed boards in a warm room 15° C or more. This known finger-jointing plant has several disadvantages. It is not capable of working with cold or even frozen boards because glueing cannot be performed below a certain temperature i.e. 15° C for most glues. Further, in order to reduce storage time, the temperature of the storage-room has to be chosen sufficiently high i.e. 20° C or more.

It is already known to use dielectric heating of the glued joints in order to eliminate storage. In such a known plant the glued boards at the output of the press are conveyed through a dielectric heating device and heated to a temperature sufficient to obtain very rapid curing, such that afterwards the long assembled board may be fed into a planing machine without danger of damaging the joints. In this known plant the whole boards, and not only the ends of the boards have to pass through a very long dielectric heating device so that an important amount of heating energy is needed. Further, as the glued joints are conveyed through the dielectric heating device, the curing of the glue is influenced by the dielectric properties of the glue. Moreover, excess glue falling on the electrodes may disturb the operation of the dielectric heating device.

SUMMARY OF THE INVENTION

In order to overcome the disadvantages of the known finger-jointing plants in accordance with the invention, the curing of the glue is not performed by dielectric heating of the glue in the joints, but dielectric heating is applied to the crude ends of the boards even before the fingers are cut in them. The ends of the boards only are fed in and out of the dielectric heating means and conveyed to finger-cutting means where wedgelike fingers are cut in the heated ends. Glue is applied to the hot cut fingers and assembling and pressing together of the hot glue-coated fingers is performed rapidly. The curing of the glue is provided by the heat accumulated in the ends of the boards and no further heating or storage in warm rooms is necessary, even if the ambient temperature is below the freezing-point. The heating energy is relatively low as only the ends are heated, whilst the middle parts between both ends of the boards may remain unheated and even frozen. The length of the end to be heated by dielectric heating and the temperature at the output of the dielectric heating means are chosen sufficient in order to accumulate in these ends the amount of calories necessary for the curing of the glue and to compensate for the heat-losses before the curing process is completed.

As the curing of the joints is very rapid, a machining device may operate on the jointed board at the output of the pressing means. The short conveying time of the board between the pressing means and the machining device is sufficient for curing the glue to a point at which the joints are able to resist the forces exerted by the machining device.

BRIEF DESCRIPTION OF THE DRAWINGS

For a better understanding of the invention, reference may be had to the preferred embodiment exemplary of the invention shown in the accompanying drawings, in which:

FIG. 2 is a schematic diagram of an entire finger-jointing plant of which FIG. 1 is a part.

DESCRIPTION OF A PREFERRED EMBODIMENT

Figure 1:
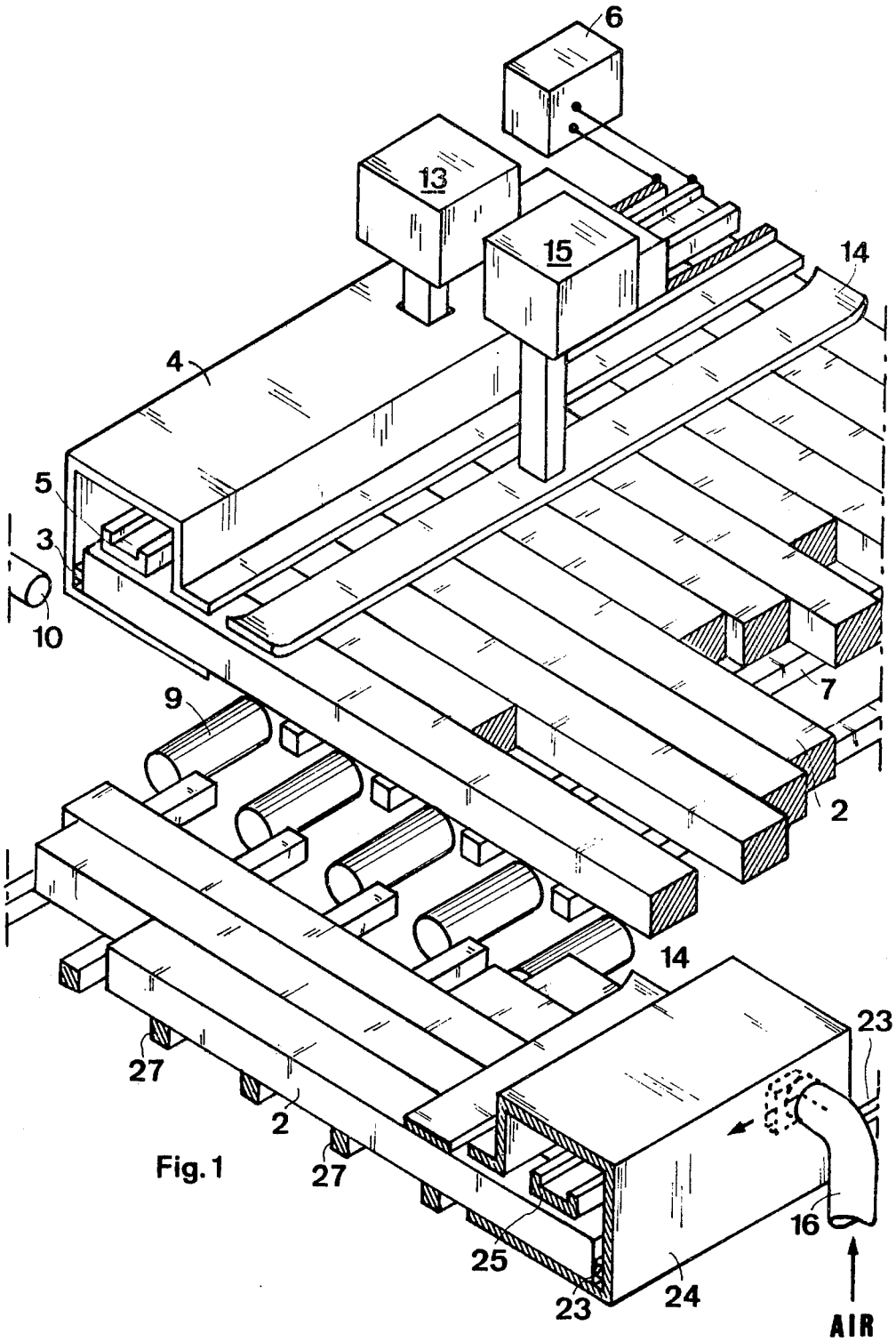
FIG. 1 is a perspective view, partially cut, of the part of the finger-jointing plant comprising the dielectric heating device.
Figure 2:
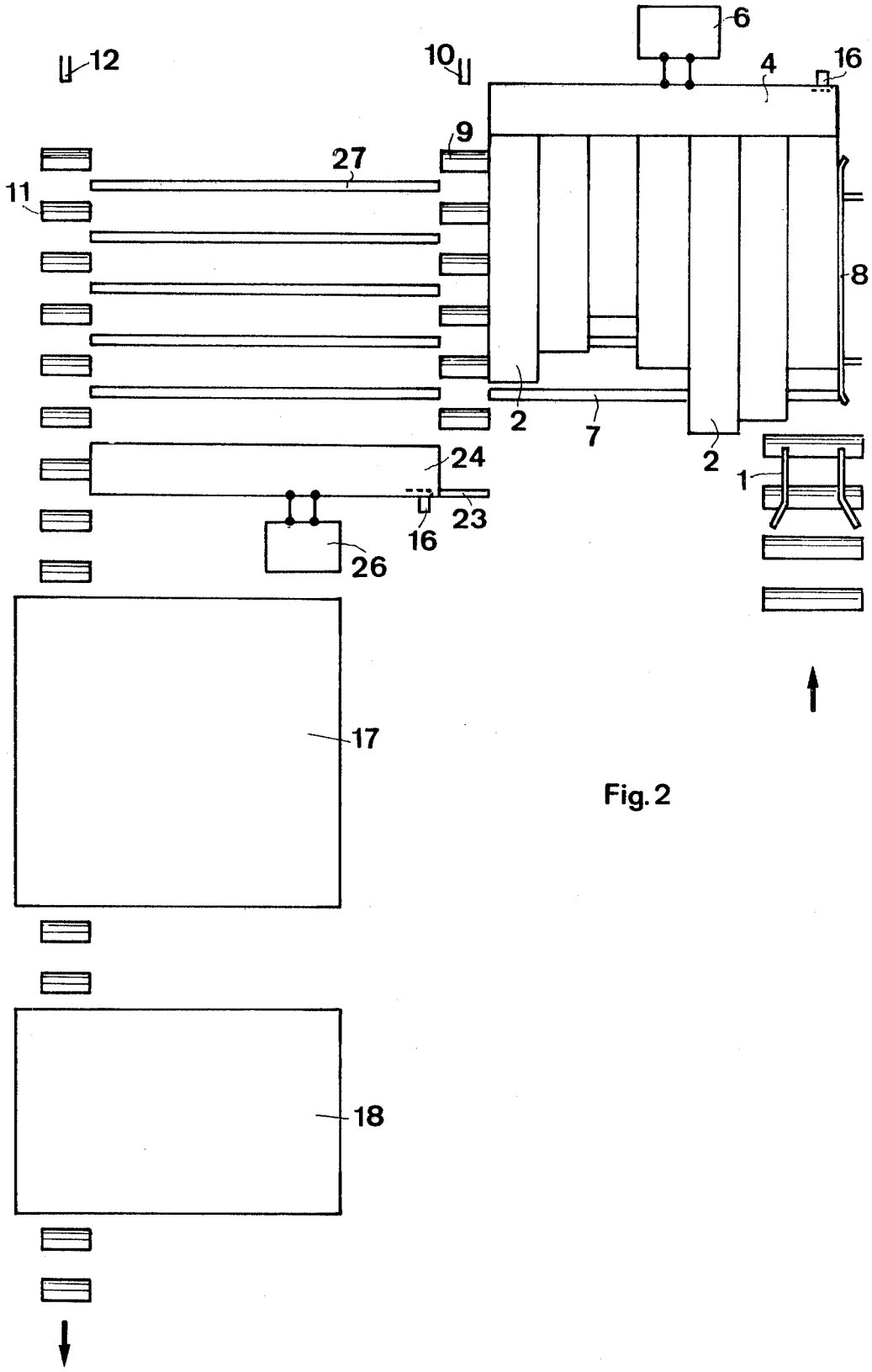

The plant showed in FIGS. 1 and 2 is fed through an input guide 1 with wood boards 2, generally of unequal length. If wood-boards with uneven end-faces have to be utilized, the plant may be equipped with a sawing device, not shown, located before the input guide 1, cutting away the uneven ends and delivering boards with end faces perpendicular to their long edges. The incoming boards 1 are pushed either by hand or by a motored device (not shown) against a stop bar 3 of a dielectric heating means. The dielectric heating means consists of an elongated, open, earthed casing 4 and a live electrode 5 surrounded by the casing 4. The live electrode 5 is connected to the not earthed bushing of a suitable high-frequency generator 6. The stop bar 3 is fixed to the wall of the casing 4 opposite to its longitudinal opening. Guiding and transporting means for the wood-boards include supporting rails 7, parallel to the casing 4, a pushing bar 8, a roller-conveyor 9, a ram 10, a roller-conveyor 11 and a ram 12. The pushing bar 8 and the rams 10 and 12 are energized by suitable i.e. pneumatic or hydraulic devices. The pushing bar 8 conveys the boards parallel to themselves on the supporting rails 7. During this movement the ends of the boards 2 remain in the casing between the bottom of the casing and the live electrode where a high-frequency field is established and heat is generated in the interior of the ends of the wood-boards located between the live electrode 5 and the bottom of the casing 4. The amount of heat generated may be controlled by the rate at which the boards are conveyed through the high-frequency field, by the length of the high-frequency field which is equal to the length of the live electrode and by the intensity of the high-frequency field. This intensity may be controlled by a controlling device, (not shown) of the voltage of the generator 6 provided in the interior of the generator 6 or by a positionning device 13 extending into the casing 4 and positioning the live electrode 5 relative to the bottom of the casing 4. A pressing bar 14 energized by a device 15 outside of the casing 4, extending parallel and adjacent to the casing, maintains the ends of the boards away from the live electrodes by pressing them against the bottom of the casing 4. A blowing means i.e. a feeding tube 16 of compressed air blows air into the space between the bottom of the casing and the live electrode. The end of the tube 16 points in the direction of the longitudinal extension of the live electrode 5 so that the air-stream leaving it continually cleans the space between the live electrode and the boards 2 in order to prevent breakdowns of the high-frequency field due to saw-dust particles aligning in the electric field.

The plant operates as follows; wood-boards 2 are fed through the input guide 1 either by hand or with the aid of an automatic device (not shown). The boards are pushed into the casing 4 against the stop bar 3. The pushing bar 8 operates by successive strokes at a rate that determines the speed with wich the ends of the boards travel through the high-frequency field between the live electrode 5 and the bottom of the casing 4. When leaving the casing 4 at the end opposite the input end, the boards are pushed on the roller-conveyor 9. There, they may be pushed by the ram 10 against a stop bar 23 of an other dielectric heating device consisting of a casing 24, a live electrode 25, a high frequency generator 26 and supporting rails 27 similar to the corresponding elements 4, 5, 6, 7 of the dielectric heating device described above. The boards continue to be conveyed in a direction perpendicular to their long edges either by the action of the pushing bar 8 or of an other convenient device, not shown. When leaving the casing 24, the boards are pushed on a second roller-conveyor 11 where they are pushed by a ram 12 into an installation 17 which may be of a conventional design and include finger-cutting means for cutting wedge-like fingers into the ends of the boards, means for applying glue on the fingered ends and assembling and pressing means for assembling the glue-coated, fingered ends of the boards in an end-to-end relationship and pressing them one against the other, so that at the output of installation 17 a jointed board of great length is produced, from which desired lengths may be cut at will.

According to the invention the ends of the boards are heated in the dielectric heating devices throughout their mass to a more or less uniform temperature of, say 90° C, whilst the whole length outside the ends is not heated and may even remain frozen. The length of the heated end is determined by the dimensions of the casing 4 and the live electrode. As dielectric heating generates heat uniformly in the heart of the board exposed to the high-frequency field, a relatively high temperature and uniform temperature-distribution is obtained within a very short time so that a considerable amount of heat is accumulated in the heated ends of the boards 2.

In certain special cases, only one end of each board has to be heated. The heat accumulated in this one end must be sufficient for curing the glue of a joint between a cold end of one board and a hot end of another board and to compensate for the heat losses from the joint before the curing process is completed. In this case the heating device 4, 5, 6, 7 the conveying rollers 9 and the ram 10 in FIGS. 1 and 2 are not necessary.

Generally, however, it is better to heat both ends of the boards that have to be jointed and this is done, preferably, in two distinct dielectric heating devices as shown in the drawing. Thanks to such sufficient heating and to rapid conveying and operation in the installation 17, the curing of the glue in the joints takes place when these joints are at a relatively high temperature, say about 60° C and is therefore very rapid. Then, a machining device, such as a planing machine 18 may operate at the output of the pressing means of the installation 17. In such a case, the short conveying time of the board between the output of the pressing means and the input of the planing machine adds sufficient time for curing the glue to a point at which the joints are able to resist the forces exerted by the planing machine.

At the output of the planing machine a sawing device for cutting desired lengths of the outcoming board, (not shown) may be provided, as is the case of conventional finger-jointing plants.

The embodiments of the invention in which an exclusive property or privilege is claimed are defined as follows:

1. A plant for jointing wood-boards, comprising dielectric heating means, guiding and transporting means for the boards to convey the ends of the boards into and out of the dielectric heating means, means for cutting fingers into the heated ends of the boards, located at the output of the dielectric heating means, means for applying glue to the heated, fingered ends of the boards, located at the output of the cutting means, assembling and pressing means, located at the output of the glueing means, for assembling the glued, heated, fingered ends of the boards in an end-to-end relationship and pressing them one against the other, whilst curing the glue is provided by the heat accumulated in the heated fingered ends.

2. A plant as claimed in claim 1 including a machining device, the input of this machining device being located at the output of said assembling and pressing means.

3. A plant as claimed in claim 1, wherein the dielectric heating means comprises a first earthed casing having an input and an output and a first live electrode substantially surrounded by said first casing, said first casing having a bottom, a wall, a cover part and an open channel, said first live electrode being connected to a high-frequency generator, and wherein said guiding and transporting means comprises means for conveying the boards with first ends of said boards inserted in the channel from the input of said first casing to its output in a direction perpendicular to the long edges of the boards, with said first ends of the boards in the high-frequency field between the first casing and the first live electrode and, at the output of said first casing, for conveying the boards in a direction parallel to their long edges into an installation comprising said finger-cutting, glue-applying, assembling and pressing means.

4. A plant as claimed in claim 3 wherein the dielectric means, further includes a second earthed casing having an input and an output and a second live electrode substantially surrounded by said second casing, said second casing having a bottom, a wall, a cover part and an open channel, said second live electrode being connected to a high-frequency generator, and wherein said guiding and transporting means comprises means for conveying the boards with second ends of said boards inserted in the channel from the input of said second casing to its output in a direction perpendicular to the long edges of the boards with said second ends of the boards in the high-frequency field betwen said second casing and said second live electrode, and for conveying the boards in a direction parallel to their long edges from the output of said second casing to the input of said first casing.

5. A plant as claimed in claim 3 including a device positioning said live electrode at a desired distance respective to the bottom of the first casing.

6. A plant as claimed in claim 3 including blowing means for blowing air in the space between said first live electrode and the bottom of the casing.

7. A plant as claimed in claim 3 including pressing means at the outside of said casing extending parallel and adjacent to said casing and pressing the boards against the bottom of said casing.

8. A plant for jointing the wood-boards comprising:

a. dielectric heating means for heating said boards;

b. means for cutting fingers into the heated ends of said boards;

c. means for conveying said boards from said dielectric heating means to said cutting means;

d. means for applying glue to said heated, fingered ends of said boards; and e. means for assembling and pressing said glued, heated, fingered ends of said boards in an end-to-end relationship and pressing them one against the other, wherein curing of the glue is provided by the heat accumulated in the heated, fingered ends.

9. A plant for jointing wood-boards as claimed in claim 8, further including means for guiding and transporting said boards into and out of said dielectric heating means.

10. A plant as claimed in claim 9, wherein the dielectric heating means consists of a first earthed casing and a first electrode substantially surrounded by said first casing, said first casing having a bottom, a wall, a cover part and an open channel, said first electrode being connected to a high-frequency generator, and wherein said guiding and transporting means comprises means in conveying the boards with first ends inserted in the channel from an input of said first casing to an output thereof in a direction perpendicular to the long edges of the boards, with said first ends of the boards in the high-frequency field between the first casing and the first electrode and, at the output of said first casing, for conveying the boards in a direction parallel to their long edges into an installation comprising said finger-cutting, glue-applying, assembling and pressing means.

11. A plant as claimed in claim 10, wherein the dielectric heating means further includes a second earthed casing and a second electrode substantially surrounded by said second casing, said second casing having a bottom, a wall, a cover part and an open channel, said second electrode being connected to a high-frequency generator, and wherein said guiding and transporting means comprises means for conveying the boards with second ends inserted in the channel of said second casing from an input of said second casing to an output in a direction perpendicular to the long edges of the boards with said second ends of the boards in the high-frequency field between said second casing and said second electrode, and for conveying the boards in a direction parallel to their long edges from the output of said second casing to the input of said first casing.

12. A method of jointing wood-boards, comprising the steps of:

a. heating the ends of said boards;

b. cutting fingers into said heated ends of said boards;

c. applying glue to said heated, fingered ends of said boards;

d. assembling said glued, heated, fingered ends of said boards in an end-to-end relationship;

e. pressing said glued, heated, fingered boards one against the other; and f. curing said glue by means of the heat accumulated in the heated, fingered ends.

13. The method of jointing wood-boards of claim 12, further comprising the step of machining said finger-jointed boards.

* * * * *